US009481170B2

(12) United States Patent
Kondo et al.

(10) Patent No.: US 9,481,170 B2
(45) Date of Patent: Nov. 1, 2016

(54) PRINTING APPARATUS AND PRINTING METHOD

(71) Applicant: SEIKO EPSON CORPORATION, Tokyo (JP)

(72) Inventors: Manabu Kondo, Nagano (JP); Yasuhiko Yoshihisa, Nagano (JP); Takayuki Tanaka, Nagano (JP); Yohei Nunokawa, Nagano (JP); Hitoshi Igarashi, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/288,981

(22) Filed: May 28, 2014

(65) Prior Publication Data

US 2014/0354722 A1 Dec. 4, 2014

(30) Foreign Application Priority Data

May 31, 2013 (JP) ..... 2013-115025

(51) Int. Cl.

| | |
|---|---|
| ***B41J 29/38*** | (2006.01) |
| ***B41J 2/07*** | (2006.01) |
| ***B41J 3/407*** | (2006.01) |
| ***B41J 19/20*** | (2006.01) |
| ***B41J 13/00*** | (2006.01) |

(52) U.S. Cl.

CPC *B41J 2/07* (2013.01); *B41J 3/407* (2013.01); *B41J 13/0027* (2013.01); *B41J 19/207* (2013.01)

(58) Field of Classification Search

CPC ..... B41J 2/07

USPC ..... 347/5, 9, 14, 16, 37; 400/283

See application file for complete search history.

(56) References Cited

U.S. PATENT DOCUMENTS

| | | | | |
|---|---|---|---|---|
| 5,801,722 | A | 9/1998 | Ueda et al. | |
| 6,827,511 | B2 * | 12/2004 | Uchikata | 400/283 |
| 2006/0012630 | A1 * | 1/2006 | Niekawa | 347/37 |
| 2010/0002205 | A1 * | 1/2010 | Suzuki | 355/22 |
| 2010/0013903 | A1 | 1/2010 | Suzuki | |

FOREIGN PATENT DOCUMENTS

| | | | |
|---|---|---|---|
| JP | 2010-023230 | A | 2/2010 |

* cited by examiner

*Primary Examiner* — Lam Nguyen

(74) *Attorney, Agent, or Firm* — Global IP Counselors, LLP

(57) ABSTRACT

When printing is performed by discharging ink from a printing head onto a lenticular, a carriage motor is controlled such that a carriage is moved in a main scanning direction at a velocity which is slower than a movement velocity of the carriage at the time of performing a normal printing process with respect to a recording medium different from the lenticular as a recording paper and further separated from a home position, and the printing head is controlled such that an ink discharge having a color according to printing data is started with respect to an end portion of the lenticular, and thus the printing of one pass is started. Since the velocity is slower than the movement velocity of the carriage at the time of performing the normal printing process, it is possible to improve printing quality at the time of performing printing with respect to the lenticular.

4 Claims, 6 Drawing Sheets

PRINTING APPARATUS AND PRINTING METHOD

BACKGROUND

1. Technical Field

The present invention relates to a printing apparatus and a printing method.

2. Related Art

As disclosed in JP-A-2010-23230, a printing apparatus in which printing is performed by discharging ink onto a recording medium having a lenticular lens in which a plurality of semi-cylinder-shaped lens components are disposed in parallel on a recording layer has been proposed in the related art. In this apparatus, a cutout width of an edge portion of the lens component which constitutes the lenticular lens is detected, and a discharge position of the ink is adjusted on the basis of the cutout width, thereby allowing printing to be performed in accordance with an arrangement of the lens components even when the edge portion of the lens component of the lenticular lens has a cutout portion.

In general, when printing is performed with respect to a recording medium having a lens sheet such as the lenticular lens in which a plurality of lens bodies are disposed in parallel, it is required that the ink be landed with a positioning accuracy which is higher than the positioning accuracy at the time of performing printing with respect to other types of recording mediums without having the lenticular lens. In the printing apparatus described above, when printing is performed with respect to the recording medium having the lens sheet, the cutout width of the edge portion of the lens component is detected, and the discharge position of the ink is adjusted on the basis of the cutout width, but there is a demand for improving printing quality by landing the ink with high accuracy by a more simple method.

SUMMARY

An advantage of some aspects of the invention is to improve printing quality with respect to a printing medium having a lens sheet by a more simple method.

A printing apparatus, a printing medium, and a printing method of the invention have adopted the following means.

According to an aspect of the invention, there is provided a printing apparatus which performs printing by discharging fluid from a printing head onto a first printing medium having a lens sheet and a second printing medium different from the first printing medium, including: a transport unit which transports the first printing medium and the second printing medium to a fluid discharge region in which the printing head is able to discharge the fluid; and a control unit which controls the printing head and the transport unit such that a velocity of the printing head with respect to the first printing medium at the time of performing printing by discharging the fluid from the printing head onto the first printing medium is slower than a velocity of the printing head with respect to the second printing medium at the time of performing printing by discharging the fluid from the printing head onto the second printing medium.

According to the printing apparatus of this aspect, the printing head and the transport unit are controlled such that the velocity of the printing head with respect to the first printing medium at the time of performing printing by discharging the fluid from the printing head onto the first printing medium is slower than the velocity of the printing head with respect to the second printing medium at the time of performing printing by discharging the fluid from the printing head onto the second printing medium. Accordingly, it is possible to perform printing by discharging the fluid onto a suitable position compared to a case where the velocity of the printing head with respect to the first printing medium at the time of performing printing with respect to the first printing medium is equal to the velocity of the printing head with respect to the second printing medium at the time of performing printing with respect to the second printing medium, thereby allowing printing quality to be improved.

In the printing apparatus according to this aspect, the first printing medium may be formed such that a plurality of lens bodies are disposed in parallel, and the lens body disposed on one end portion has low shape accuracy compared to the other lens bodies, and the control unit may control the printing head such that a fluid discharge is performed from an end portion of the first printing medium which is opposite to the one end portion as a discharge start position when printing is performed with respect to the first printing medium. According to the printing apparatus of this aspect, when printing is performed with respect to the first printing medium, the fluid discharge is started from the end portion on which the lens body having high shape accuracy is disposed as the printing start position, and thus it is possible to perform printing by discharging the fluid onto the suitable position by a more simple method compared to a case of detecting a cutout width of an edge portion of the lens body, thereby allowing printing quality to be improved.

In addition, in the printing apparatus according to this aspect, a printing head movement unit which reciprocates the printing head in a main scanning direction may be further included, and the control unit may control the printing head, the transport unit, and the printing head movement unit such that the velocity of the printing head with respect to the first printing medium at the time of performing printing by discharging the fluid from the printing head onto the first printing medium is slower than the velocity of the printing head with respect to the second printing medium at the time of performing printing by discharging the fluid from the printing head onto the second printing medium. According to the printing apparatus of this aspect, it is possible to perform printing by discharging the fluid onto the more suitable position even in the printing apparatus provided with the printing head movement unit which reciprocates the printing head in the main scanning direction, thereby allowing printing quality to be improved.

In the printing apparatus according to this aspect which is provided with the printing head movement unit which reciprocates the printing head in the main scanning direction, a tray for printing in which the first printing medium is able to be set may be further included, the transport unit may be formed such that the tray for printing is able to be inserted from a downstream side of a sub-scanning direction, and include a first roller which is provided on an upstream side of the sub-scanning direction from the printing head and transports the tray for printing, and a second roller which is provided on a downstream side of the sub-scanning direction from the printing head and transports the tray for printing, and the control unit may control the printing head and the printing head movement unit such that when the tray for printing having the first printing medium set therein is transported by the first roller and the second roller, printing is performed with respect to the first printing medium by discharging the fluid from the printing head while the printing head is moved at a velocity which is faster than the velocity at the time of transporting the tray for printing having the first printing medium set therein by either the first roller or the second roller. According to the printing apparatus of this aspect, it is possible to perform printing by discharging the fluid onto the more suitable position even when a warp is formed on the end portion of the first printing medium in the sub-scanning direction, thereby allowing printing quality to be improved. In addition, when the tray for printing having the first printing medium set therein is transported by the first roller and the second roller, the printing head is moved at a velocity which is faster than the velocity at the time of transporting the tray for printing having the first printing medium set therein by either the first roller or the second roller, thereby allowing printing throughput to be improved.

In addition, in the printing apparatus according to this aspect which is provided with the printing head movement unit which reciprocates the printing head in the main scanning direction, at the time of performing printing with respect to the first printing medium, the control unit may control the printing head and the printing head movement unit such that the fluid is discharged when the printing head is moved in a direction to the one end portion from the other end portion of the first printing medium, and may control the printing head and the printing head movement unit such that the printing head is moved at a velocity which is faster than the velocity at the time of moving the printing head in the direction to the one end portion from the other end portion without discharging the fluid when the printing head is moved in a direction to the other end portion from the one end portion of the first printing medium. According to the printing apparatus of this aspect, it is possible to perform printing by discharging the fluid onto the more suitable position even in the printing apparatus provided with the printing head movement unit which reciprocates the printing head in the main scanning direction, thereby allowing printing quality to be improved.

According to another aspect of the invention, there is provided a printing method in which a transport unit is used to transport a first printing medium having a lens sheet and a second printing medium different from the first printing medium to a fluid discharge region in which a printing head is able to discharge fluid, and printing is performed by discharging the fluid from the printing head, in which printing is performed with respect to the first printing medium by setting a velocity of the printing head with respect to the first printing medium at the time of performing printing by discharging the fluid from the printing head onto the first printing medium to be slower than a velocity of the printing head with respect to the second printing medium at the time of performing printing by discharging the fluid from the printing head onto the second printing medium.

According to the printing method of this aspect, printing is performed with respect to the first printing medium by setting the velocity of the printing head with respect to the first printing medium at the time of performing printing by discharging the fluid from the printing head onto the first printing medium to be slower than the velocity of the printing head with respect to the second printing medium at the time of performing printing by discharging the fluid from the printing head onto the second printing medium. Accordingly, it is possible to perform printing by discharging the fluid onto the suitable position compared to a case where the velocity of the printing head with respect to the first printing medium at the time of performing printing with respect to the first printing medium is equal to the velocity of the printing head with respect to the second printing medium at the time of performing printing with respect to the second printing medium, thereby allowing printing quality to be improved.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
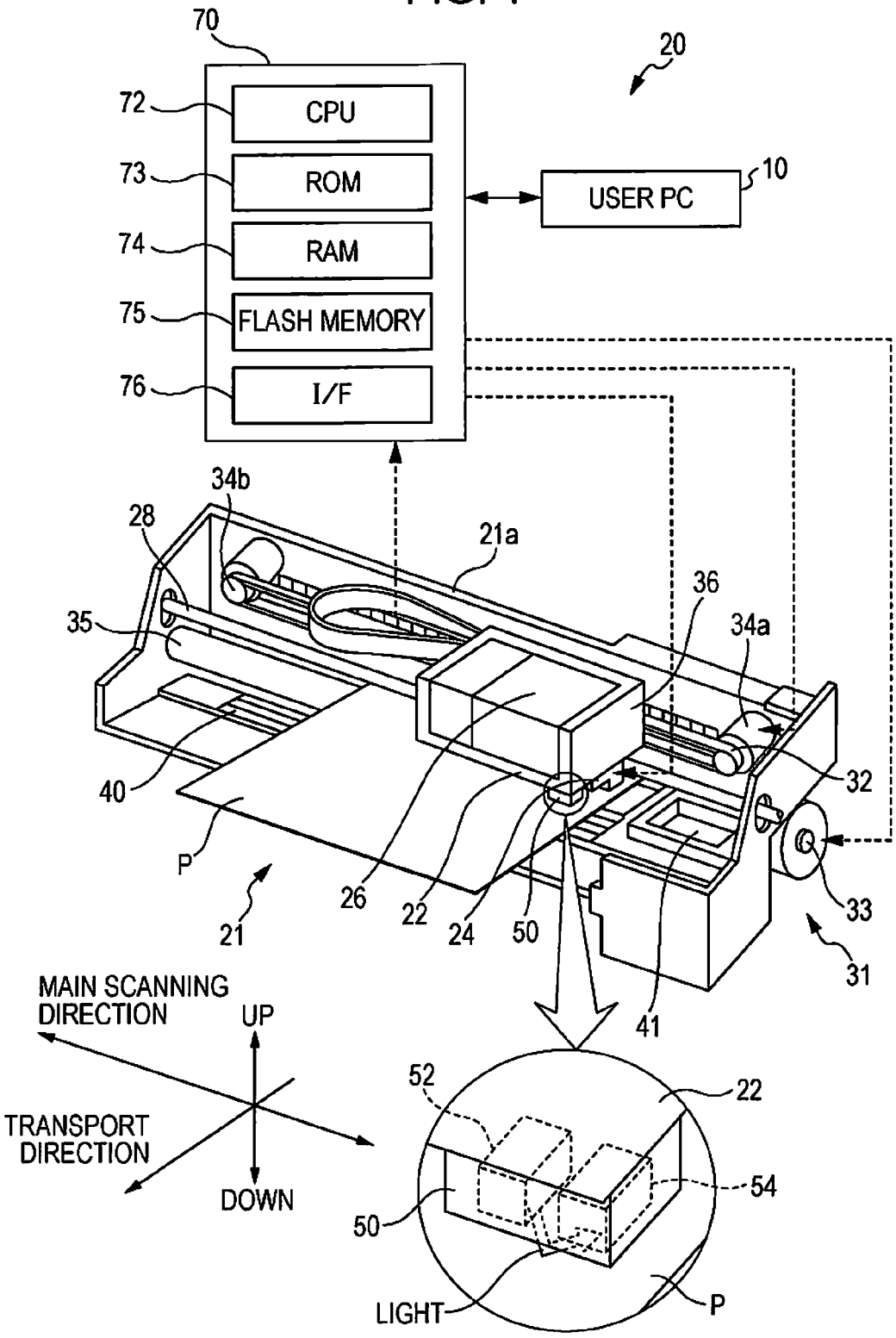
FIG. 1 is a configuration diagram illustrating a schematic configuration of an ink jet printer.

Next, embodiments of the invention will be described with reference to the drawings. FIG. 1 is a configuration diagram illustrating a schematic configuration of an ink jet printer 20 which is an embodiment of a printing apparatus of the invention. As illustrated, the ink jet printer 20 of this embodiment includes a paper feed mechanism 31 which transports recording paper P in a transport direction (a sub-scanning direction) of FIG. 1, by the driving of a paper feed roller 35 by a paper feed motor 33, a printer mechanism 21 which performs printing by discharging ink droplets from a printing head 24 onto the recording paper P transported onto a platen 40 by the paper feed mechanism 31, a Paper Width (PW) detector 50 which is attached to the printing head 24 and detects left and right ends of the recording paper P on the platen 40, a capping device 41 which is provided on a right side of the platen 40 and seals the printing head 24 in order to prevent the printing head 24 from being dried during inactivation of the printing or the like, and a controller 70 which controls the entire ink jet printer 20. Furthermore, a position on the capping device 41 is referred to as a home position.

The printer mechanism 21 includes a carriage motor 34*a* which is disposed on a right side of a machine frame 21*a*, a driven roller 34*b* which is disposed on a left side of the machine frame 21*a*, a carriage belt 32 which is provided across the carriage motor 34*a* and the driven roller 34*b*, a carriage 22 which is reciprocated by the carriage belt 32 along a guide 28 in a main scanning direction by the driving of the carriage motor 34*a*, an ink cartridge 26 which is provided in the carriage 22 and individually contains ink of each color of CMYK, that is, cyan (C), magenta (M), yellow (Y), and black (K), in which a dye or a pigment as a coloring agent is included in water as a solvent, and the printing head 24 which is supplied with the ink from the ink cartridge 26 and discharges the ink droplets. Furthermore, on a back surface of the carriage 22, a linear encoder 36 which outputs a pulse-shaped signal according to a movement of the carriage 22 is disposed, and a position of the carriage 22 is managed by the linear encoder 36.

Figure 2:
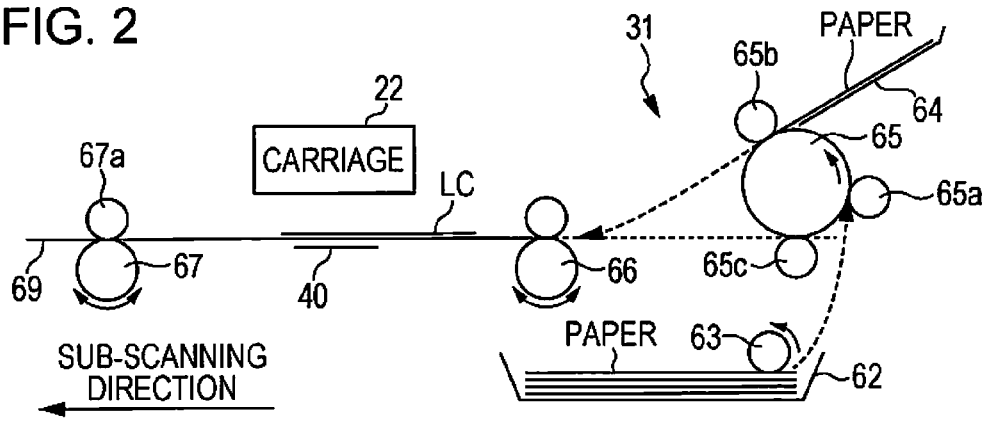
FIG. 2 is a configuration diagram illustrating a schematic configuration of a paper feed mechanism.

As illustrated in FIG. 2, the paper feed mechanism 31 includes a pickup roller 63 which picks up the paper in a paper cassette 62 disposed in a lower portion of a housing containing the entire apparatus, a medium roller 65 which feeds the paper in a manual tray 64 disposed on a back surface side (a right side in FIG. 2) of the printer mechanism 21 or transports the paper from the pickup roller 63, a transport roller 66 which transports a printing medium (paper or the like) onto the platen 40, a paper ejection roller 67 which ejects the printing medium, and driven rollers 65*a*, 65*b*, 65*c*, 66*a*, and 67*a* which rotate according to the rotation of the medium roller 65, the transport roller 66, or the paper ejection roller 67. Furthermore, in this embodiment, in order to perform printing with respect to a lenticular LC described below, a tray (hereinafter, referred to as a LC tray) 69 in which the lenticular LC is set is able to be inserted from a downstream side (a left side of FIG. 2) of the sub-scanning direction to the transport roller 66 through a gap between the paper ejection roller 67 and the driven roller 67*a*. The LC tray 69 is transported in the sub-scanning direction by the transport roller 66 and the paper ejection roller 67 when printing is performed, and the LC tray 69 is transported to the sub-scanning direction by the paper ejection roller 67 when being separated from the transport roller 66.

The PW detector 50 is configured as a light sensor including a light-emitting element 52 (for example, a light-emitting diode or the like) and a light receiving element 54 (for example, a phototransistor or the like), receives light which is emitted from the light-emitting element 52 and reflected by the recording paper P in the light receiving element 54, and converts the light to an electric signal of a voltage which has a level according to a light amount. In the PW detector 50, since the platen 40 and the recording paper P have different light reflectance from each other, it is possible to detect the left and right ends of the recording paper P by moving the PW detector 50 across the recording paper P according to reciprocation of the printing head 24 in the main scanning direction.

The controller 70 is configured as a microprocessor dominated by a CPU 72, and includes a ROM 73 which stores various processing programs or various data items, a RAM 74 which temporarily stores data, a flash memory 75 which is able to write and erase the data, an interface (I/F) 76 which performs information transaction with an external device, and input and output ports (not illustrated). A printing buffer region is provided in the RAM 74, and a printing job transferred from a user PC 10 which is a general-purpose personal computer through which the I/F 76 is stored in the printing buffer region. To the controller 70, a positional signal from the linear encoder 36, a signal from the PW detector 50, or the like is input through the input port. In addition, from the controller 70, a drive signal to the printing head 24, a drive signal to the paper feed motor 33, a drive signal to the carriage motor 34*a*, a signal to the capping device 41, or the like is output through the output port.

In the ink jet printer 20 of this embodiment configured as above, when printing data created by the user PC 10 is received as the printing job, the received printing data is opened in the printing buffer region provided in the RAM 74, the paper feed roller 35 is rotated according to the drive of the paper feed motor 33, and the recording paper P is transported and fed from the tray 64 onto the platen 40. Then, the printing head 24 and the carriage motor 34*a* are driven such that the ink is discharged from the printing head 24 while the carriage 22 is moved within a movement range of the main scanning direction on the basis of the printing data of one pass, the paper feed roller 35 is rotated whenever the printing is ended, and the recording paper P of one pass is transported (hereinafter, referred to as a normal printing process). By repeating the normal printing process, printing is performed with respect to the recording paper P, and when the printing is completed with respect to the recording paper P of one sheet, the paper feed roller 35 is rotated to eject the recording paper P.

Here, in the normal printing process, the controller 70 causes each color ink to be discharged by driving the printing head 24 while the carriage 22 is moved over the printing region on the basis of the printing data, and the drive of the printing head 24 to be stopped when the carriage 22 arrives at an end position (a head drive stop position) of the printing region. In addition, the controller 70 controls the carriage motor 34*a* such that the carriage 22 is accelerated from a state of being stopped, moved within the printing region at a substantially constant rate, and decelerated and stopped when the drive of the printing head 24 is stopped. For this reason, in the normal printing process, a movement range (a CR movement range) of the carriage 22 from a CR movement start position which starts the movement of the carriage 22 to a CR movement end position which ends (stops) the movement is able to be determined on the basis of a range which is necessary for the printing region, and acceleration and deceleration.

In addition, the ink jet printer 20 of this embodiment is able to use a plurality of types of paper having sizes different from each other such as A4 paper or B5 paper, postcard size, L-size, or the like as the recording paper P, and the recording paper P is fed based on a center of the paper regardless of the size, that is, the recording paper P is fed (transported) by using a center paper feeding.

Figure 3:
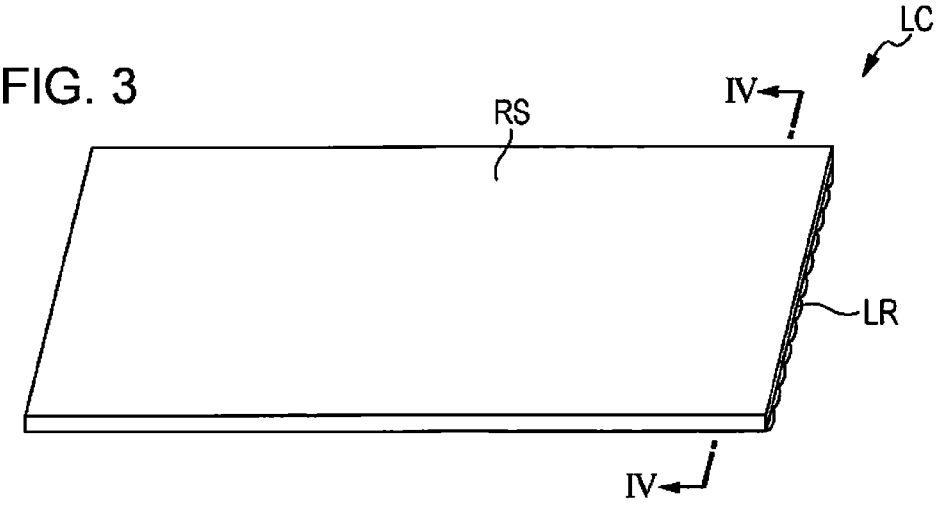
FIG. 3 is a configuration diagram illustrating a schematic configuration of a lenticular.
Figure 4:
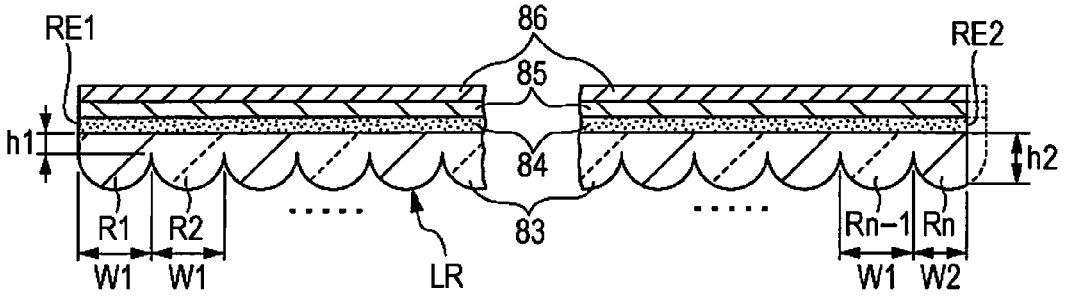
FIG. 4 is a sectional view illustrating a schematic cross-section cut along line IV-IV of FIG. 3.

Further, the ink jet printer 20 of this embodiment is able to use the lenticular LC as the recording paper P. FIG. 3 is a configuration diagram illustrating a schematic configuration of a lenticular LC, and FIG. 4 is a sectional view illustrating a schematic cross-section cut along line IV-IV of FIG. 3. The lenticular LC includes a sheet-shaped lenticular lens LR in which lens bodies R1 to Rn (n is an integer greater than or equal to 2) are arranged in parallel. The lens bodies R1 to Rn-1 not including the lens body Rn disposed on an end portion RE2 are formed in the shape of a semi-cylinder having a substantially constant shape accuracy in which widths (lens widths) in a left and right direction are approximately the same as a width W1. The lens body R1 is disposed on an end portion RE1 of the lenticular LC such that a concave portion thereof conforms to the end portion RE1. As illustrated by a broken line in FIG. 4, the lens body Rn disposed on the end portion RE2 of the lenticular LC is formed to have a lens width W2 which is smaller than the lens width W1 of the lens bodies R1 to Rn-1 and a shape in which a part of the lens bodies R1 to Rn-1 is cut out. That is, the lens body Rn has low shape accuracy compared to the lens bodies R1 to Rn-1. In the lenticular LC, an image having a parallax is directly printed on a surface RS (that is, an ink absorption layer 86) which is a side of the lenticular lens LR opposite to a concave and convex surface. The user observes the printed image through the lenticular lens LR, thereby observing the printed image as a three-dimensional image.

Figure 7A:
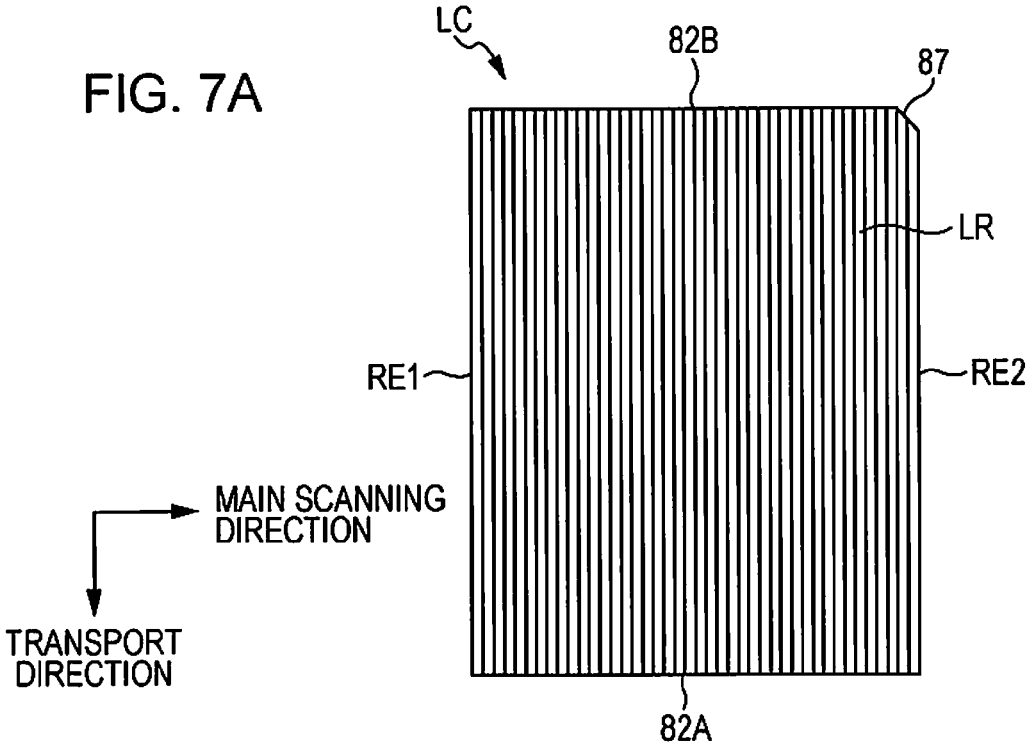
FIG. 7A is a plan view when the lenticular as an example of a recorded medium according to the invention is viewed from a lens layer side.
Figure 7B:
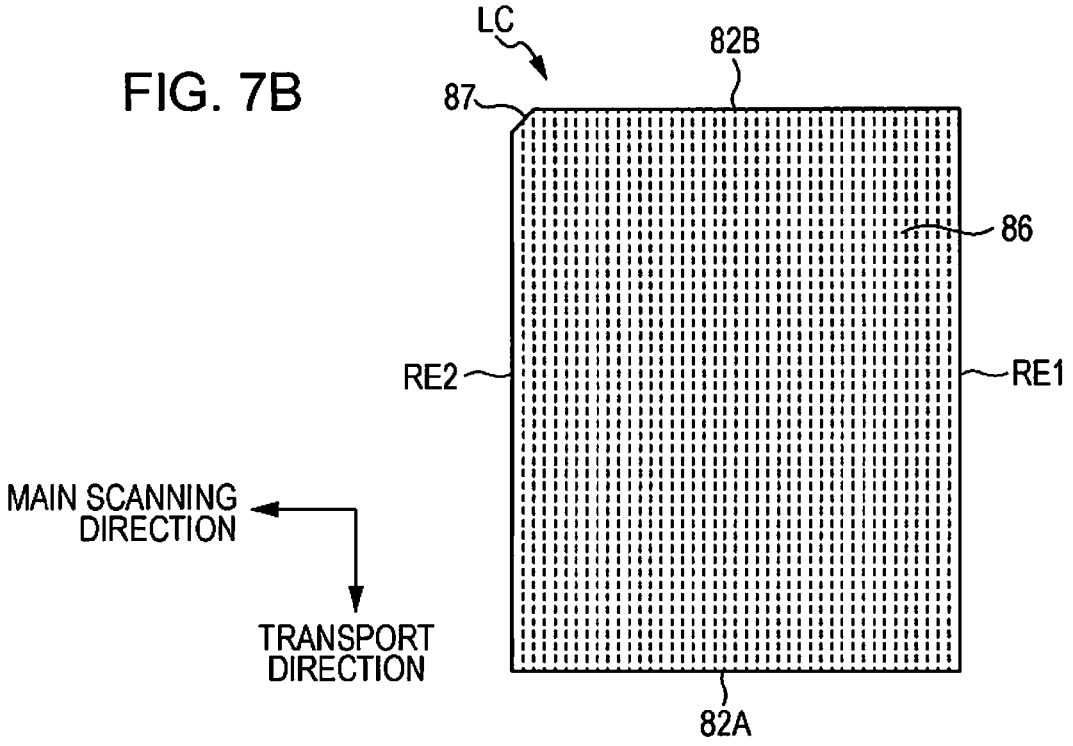
FIG. 7B is a plan view when the lenticular is viewed from an ink absorption layer side.

Further, in the lenticular LC, the end portion RE1 of one side and the end portion RE2 of the other side in the main scanning direction are asymmetrically formed. Specifically, as illustrated in FIG. 7, a part of the end portion RE2 is cut out (a part illustrated by a reference numeral 87), and thus the end portion RE1 and the end portion RE2 are in an asymmetric form. The cutout portion 87 is a spot (a discrimination mark), and when recording is performed by a printer 1 described below, it is possible to easily and reliably align an end surface of the one side, that is an end surface (the end portion RE1 in this embodiment) as a criterion in a suitable direction, thereby allowing a preferable recording result to be more reliably obtained.

Furthermore, as an example, the cutout portion 87 is formed to have an angle of 45 degrees with respect to the main scanning direction and the transport direction. That is, any shape, any position, and any size may be used insofar as a user is able to discriminate on which side the end portion RE1 as the criterion is positioned.

Figure 8:
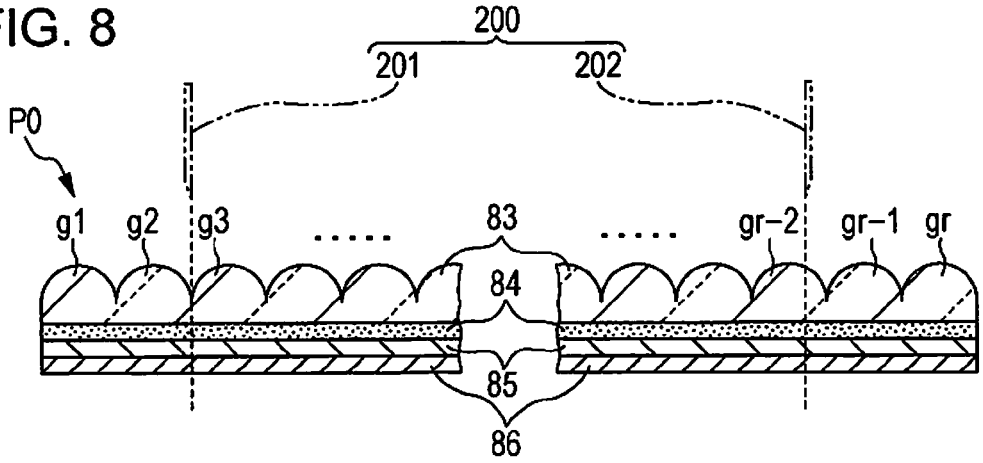
FIG. 8 is a diagram schematically illustrating a position adjustment in a punching process of the lenticular.

In addition, an entire cutting machine for forming (cutting, and punching) the lenticular LC is not illustrated, but a punching die 200 at the time of punching the lenticular LC from a lenticular P0 (a sheet which is a base of the lenticular LC and has a size larger than that of the lenticular LC) is illustrated in FIG. 8. Since the lenticular LC according to this embodiment is in the shape of a rectangle, the punching die 200 is also in the shape of a rectangle according to the shape of the lenticular LC, and configured by 4 blades in order to form (punch) 4 sides of the lenticular LC. Reference numerals 201 and 202 indicate 2 facing blades which constitute the 4 blades. The other 2 blades are omitted in FIG. 8.

As illustrated in FIG. 8, the respective lenses are indicated by reference numerals g1 to gr, and the lenticular LC after being punched, is configured by the lenses g3 to gr-2. That is, the lens g3 in FIG. 8 is a lens R1 from FIG. 4, and the lens gr-2 in FIG. 8 is a lens Rn from FIG. 4.

As illustrated in FIG. 8, a punching process performs a position adjustment of a blade 201 to a position between the adjacent lens g2 and lens g3 in the main scanning direction of FIG. 8, and then punches out the lenticular.

That is, a cutting blade (the blade 201 in FIG. 8) is precisely managed such that the cutting blade is inserted into a position which is exactly matched to a valley of the adjacent lenses gk in the invention, and a cut surface at the time of performing the cutting is the end portion RE1 of FIG. 4. The end portion RE2 of the other side in FIG. 4 is a cut surface at the time of performing the cutting without strictly managing a cutting position (without performing the position adjustment of the cutting blade).

Accordingly, as illustrated in FIG. 4, a thickness h1 of a lens layer 83 of the end portion RE1 is thinner than a thickness h2 of the lens layer 83 of the end portion RE2. Furthermore, since each thickness of the other layers not including excepting the lens layer 83 is uniform, the total thickness of the end portion RE1 is thinner than the total thickness of the end portion RE2.

In addition, the width w1 of the lens R1 for forming the end portion RE1 is wider than the width w2 of the lens Rn for forming the end portion RE2 of the other side, and the width w1 of the lens R1 corresponds to the width (w1) of the lens R2 adjacent to the lens R1. Furthermore, widths of the other lenses Rk excepting the lens on the end portion are w1.

That is, it is sufficient that the cutting position at the time of forming the end portion RE1 of the one side be precisely managed, and it is not necessary that the cutting position at the time of forming the end portion RE2 of the other side be strictly managed. Accordingly, it is possible to suppress the complication and cost increase of the cutting machine, and to prevent the cost increase of the lenticular LC.

Furthermore, for suppressing the complication and the cost increase of the cutting machine, only the end portion RE1 is strictly managed and cut, but the lenticular P0 may be measurably expanded or contracted according to various circumstances (temperature, humidity, or the like) at the time of cutting, so that the cutting position of the end portion RE2 may be managed and cut on equal terms with the end portion RE1.

Figure 9:
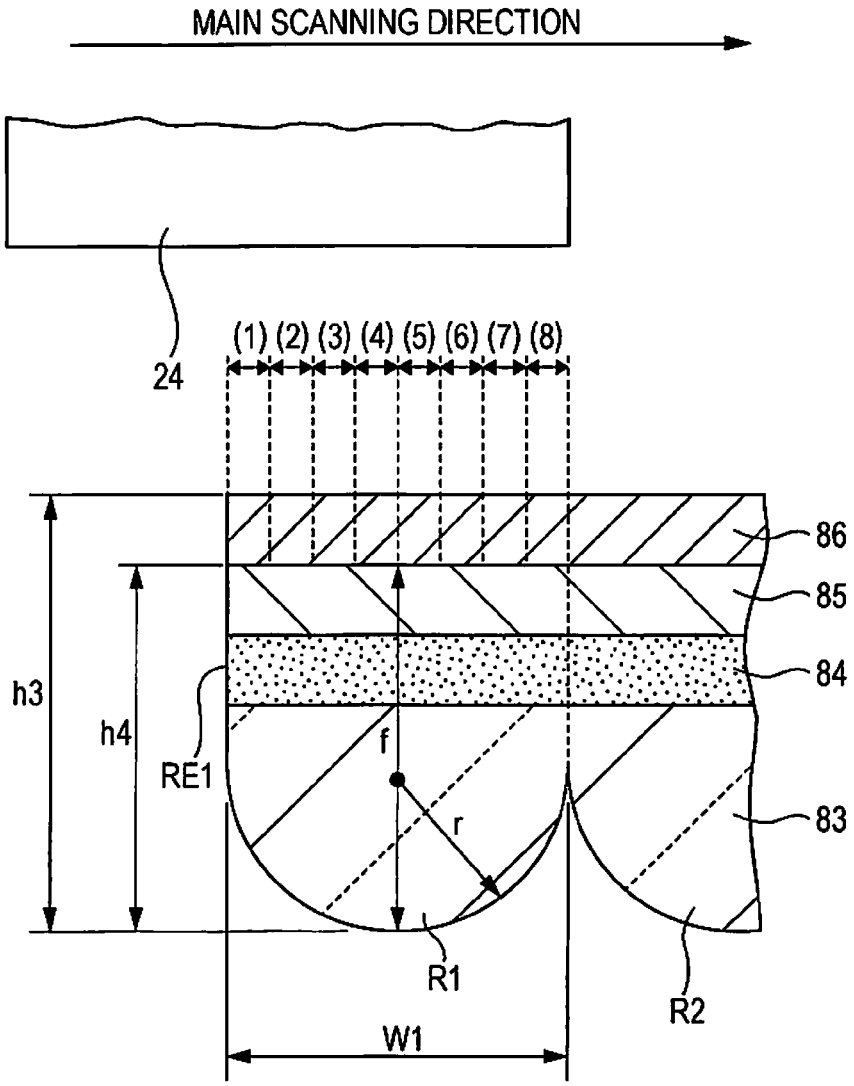
FIG. 9 is a sectional view illustrating an end surface of one side of the lenticular cut along a main scanning direction.

Furthermore, when the recording is performed with respect to the lenticular LC based on the end portion RE1 formed by being precisely cut, it is possible to prevent the image to be recorded on one lens Rk from being recorded across the other adjacent lenses. That is, in an example of FIG. 9, it is possible to accurately keep all images of (1) to (8) in the lens R1, and to obtain preferable visual effects.

Figure 5:
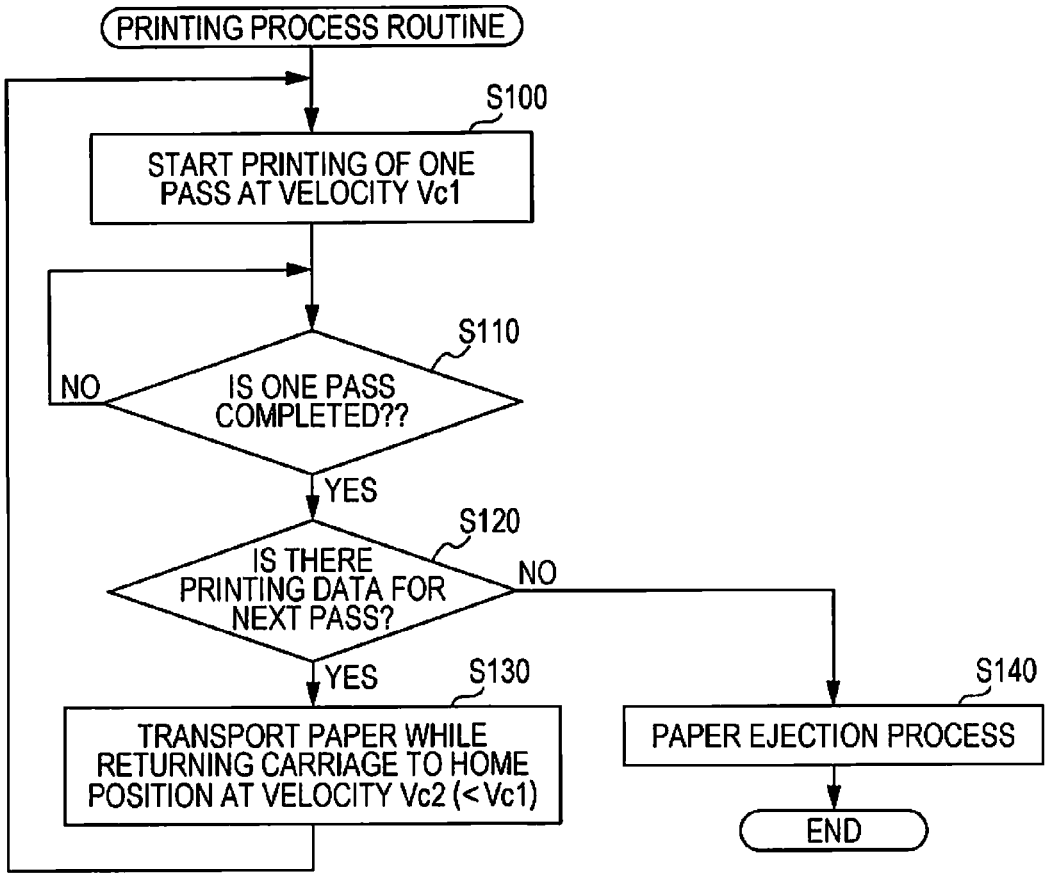
FIG. 5 is a flowchart illustrating an example of a printing process routine.

Next, an operation of the ink jet printer 20 of this embodiment configured as above will be described. FIG. 5 is a flowchart illustrating an example of a printing process routine performed by the controller 70. The routine is performed when the printing data is input from the user PC 10 in a state where the lenticular LC is selected as the recording paper P from the user PC 10, and the tray 69 in which the lenticular LC is set is inserted to the transport roller 66 through the gap between the paper ejection roller 67 and the driven roller 67*a* from the downstream side (the left side of FIG. 2) of the sub-scanning direction. At this time, the carriage 22 is positioned at a CR movement start position of the home position side. In addition, the lenticular LC is set in the tray 69 by the user such that the end portion RE1 is disposed on the home position side, and the end portion RE2 is disposed away from the home position in the main scanning direction.

When the printing process routine is performed, the CPU 72 of the controller 70 starts the printing of one pass by controlling the carriage motor 34*a* such that the carriage 22 is moved in the main scanning direction at a velocity Vc1 and separated from the home position and by controlling the printing head 24 such that an ink discharge having a color according to the printing data is started from the end portion RE1 of the lenticular LC (Step S100). Here, the velocity Vc1 uses a predetermined velocity as a velocity enabling the ink to be landed onto the lenticular LC with high positioning accuracy, and the velocity is slower than a movement velocity of the carriage 22 at the time of performing the normal printing process with respect to a various recording mediums (for example, A4 paper or B5 paper, a postcard, CDR, or the like) different from the lenticular LC as the recording paper P. At this time, since the lens body R1 having high shape accuracy is disposed on the end portion RE1 of the lenticular LC, it is possible to discharge the ink onto a suitable position with respect to the respective lens bodies R1 to Rn, and to land the ink onto the lenticular LC by starting the ink discharge from the end portion RE1 side. In addition, since the velocity Vc1 is slower than the movement velocity of the carriage 22 at the time of performing the normal printing process, it is possible to discharge and land the ink onto the suitable position with respect to the respective lens bodies R1 to Rn, compared to a case where the carriage 22 at the time of performing printing with respect to the lenticular LC is moved at a velocity which is equal to the movement velocity at the time of performing the normal printing process. Therefore, it is possible to improve printing quality.

Furthermore, for the printing, the PW detector 50 detects an edge 82A, and thus specifies a start position of the printing. At this time, the PW detector 50 may detect the cutout portion 87 by causing the carriage 22 to scan the cutout portion 87. Therefore, it is possible to suppress a printing error due to a mounting direction error of the lenticular LC by the user. That is, when the PW detector 50 detects the cutout portion 87 at the time of starting the printing, it is possible to determine that an assumed mounting direction of the lenticular LC is mounted in a direction reverse to the transport direction, and thus it is possible to perform printing from the end portion RE1 even when the lenticular LC is mounted in the direction reverse to the transport direction insofar as the direction for starting the ink discharge is able to be reversed with respect to the main scanning direction, thereby allowing printing quality to be improved. In addition, when the lenticular LC is mounted in a wrong direction by the user, the user may be notified to remount the lenticular LC. In addition, when printing is performed with respect to the lenticular LC without detecting the cutout portion 87, the mounting direction of the lenticular LC may be announced to the user in advance.

When the printing of one pass is completed by starting the printing as described above (Step S110), it is determined whether or not there is printing data for a next pass (Step S120), and when there is printing data for a next pass, the ink discharge is stopped, the carriage motor 34*a* is controlled such that the carriage 22 is moved toward the home position side at a velocity Vc2 faster than the velocity Vc1 to the brink of the home position, and the paper feed motor 33 is controlled such that the LC tray 69 of one pass is transported by the paper feed roller 35 (Step S130). When transportation of the LC tray 69 is stopped, the routine returns to the process of Step S100, and the printing of one pass is started while the carriage motor 34*a* is controlled such that the carriage 22 is moved in the main scanning direction at the velocity Vc1 to be close to the home position. In the process of Step S130, the carriage motor 34*a* is controlled such that the carriage 22 is moved at the velocity Vc2 which is faster than the movement velocity Vc1 of the carriage 22 at the time of performing printing, and thus the carriage 22 is able to be moved faster to the home position side, thereby allowing printing throughput to be improved. Here, the velocity Vc2 may be faster or slower than a velocity at the time of performing the normal printing.

Figure 6:
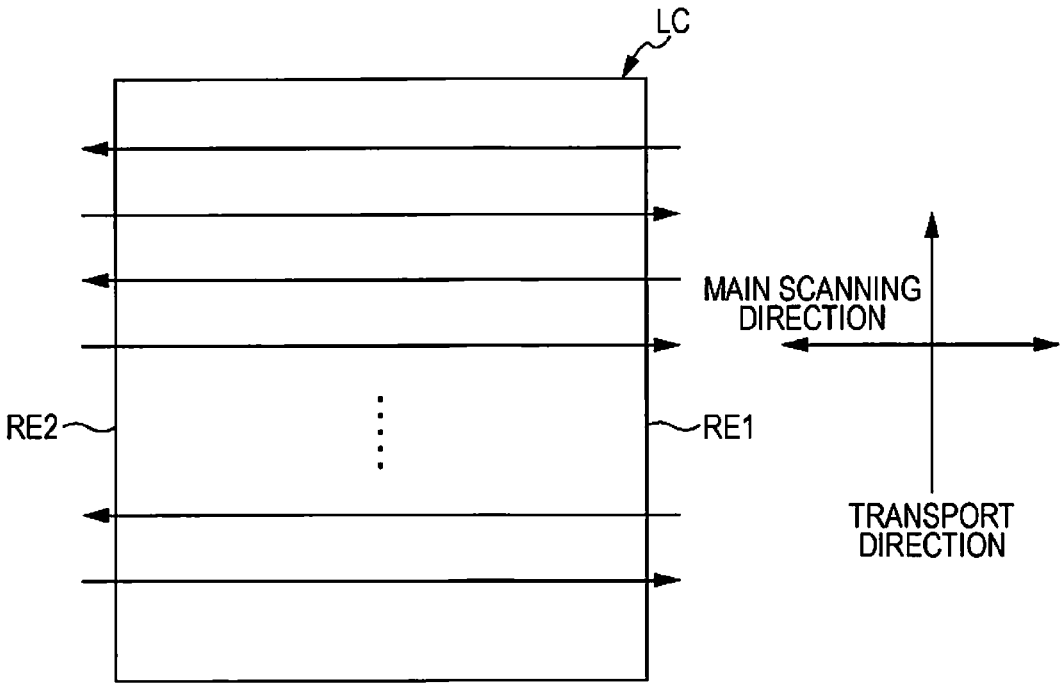
FIG. 6 is an explanatory diagram for explaining a printing direction with respect to the lenticular.

FIG. 6 is an explanatory diagram for explaining a printing direction with respect to the lenticular LC. For the lenticular LC, as illustrated, printing is performed while the carriage 22 is moved in a direction away from the home position side, that is, a direction toward the end portion RE2 from the end portion RE1, and when being moved in a direction to the end portion RE1 from the end portion RE2, the carriage 22 is moved without performing printing. In the lenticular LC, when it is not possible to discharge the ink onto the suitable position of the lens bodies R1 to Rn, a reverse view or the like is generated, and the image may not be viewed as a three-dimensional image. In this embodiment, the printing is started from the end portion RE1 conforming to the concave portion of the lens body R1 of the lenticular LC, and thus it is possible to discharge the ink onto the suitable position of the lens bodies R1 to Rn. In addition, at this time, the carriage 22 is moved at the velocity Vc1 slower than the velocity at the time of performing the normal printing, and thus it is further possible to discharge the ink onto the suitable position of the lens bodies R1 to Rn. Accordingly, it is possible to improve printing quality.

In addition, when the carriage 22 is moved in the direction to the end portion RE1 from the end portion RE2, the carriage 22 is moved at the velocity Vc2 which is faster than the velocity Vc1 at the time of moving the carriage 22 in the direction to the end portion RE2 from the end portion RE1, and thus it is possible to improve printing throughput compared to a case where the movement velocity of the carriage 22 at the time of moving the carriage 22 in the direction to the end portion RE1 from the end portion RE2 is equal to the movement velocity of the carriage 22 at the time of moving the carriage 22 in the direction to the end portion RE2 from the end portion RE1.

Thus, at the time of repeating the processes of Steps S100 to S130, when it is determined that there is no printing data for a next pass (Step S120), a paper ejection process in which the paper feed motor 33 is controlled such that the lenticular LC is ejected from the platen 40 by the driving of the paper ejection roller 67 is performed (Step S140), and this routine is ended.

Here, a correspondence relationship of components of this embodiment and components of the invention will become apparent. The lenticular LC of this embodiment corresponds to a "first printing medium", the paper corresponds to a "second printing medium", the paper feed mechanism 31 corresponds to a "transport unit", and the controller 70 corresponds to a "control unit".

According to the ink jet printer 20 of this embodiment described above, the velocity Vc1 at the time of performing printing by discharging the ink from the printing head 24 onto the lenticular LC is slower than the movement velocity of the carriage 22 at the time of performing the normal printing process, and thus it is possible to improve printing quality when printing is performed with respect to the lenticular LC. In addition, since the ink discharge is started from the end portion RE1 having high shape accuracy, it is possible to improve printing quality. Further, printing is not performed after the printing of one pass is ended, the carriage 22 is moved to the home position side at the velocity Vc2 which is faster than the movement velocity Vc1 of the carriage 22 at the time of performing printing, and thus it is possible to improve printing throughput.

In the ink jet printer 20 of this embodiment, the lenticular LC is contained in the LC tray 69 by the user such that the end portion RE1 is disposed on the home position side of the platen 40, but the lenticular LC may be formed such that a part of the end portion having high shape accuracy is cut out, the PW detector 50 may detect the end portion in which the cutout portion is formed, and the ink discharge may be started from the detected end portion. That is, when the width of the end portion RE1 and the width of the end portion RE2 are compared with each other, the end portion RE1 which is wide in width has high accuracy (strictly managed), and thus, for example, the PW detector 50 may detect the width of the lens positioned on the respective end portions, and printing may be performed from the end portion on which the lens having high accuracy is positioned.

In the ink jet printer 20 of this embodiment, the printing of one pass is performed while the carriage 22 is moved at the velocity Vc1 in the process of Step S110, but when the LC tray 69 is transported to the sub-scanning direction by the transport roller 66 and the paper ejection roller 67, the printing of one pass may be performed while the carriage 22 is moved at the velocity Vc1, and when the LC tray 69 is separated from the transport roller 66 and transported to the sub-scanning direction by the paper ejection roller 67, the printing of one pass may be performed while the carriage 22 is moved at a velocity Vc3 which is slower than the velocity Vc1. Accordingly, it is possible to perform printing by discharging the ink onto the more suitable position even when a camber is formed on the end portion of the lenticular LC in the sub-scanning direction, thereby allowing printing quality to be improved. At this time, in the ink jet printer where the LC tray 69 is in a state of being separated from the paper ejection roller 67 and transported only by the transport roller 66 at the time of inserting the LC tray 69 from the downstream side of the sub-scanning direction, and when the LC tray 69 is separated from the paper ejection roller 67 and transported by the transport roller 66, the printing of one pass may be performed while the carriage 22 is moved at a velocity Vc4 (may be equal to or not equal to the velocity Vc3) which is slower than the velocity Vc1. Furthermore, when printing is performed with respect to standard type of paper, exclusive type of paper, or the like with a high quality, the movement velocity of the carriage 22 (the recording head 24) is slow compared to a case where printing is performed by velocity priors, but when the recording is performed with respect to the lenticular LC, the movement velocity of the carriage 22 (the recording head 24) may be further slow.

In the ink jet printer 20 of this embodiment, printing is performed with respect to the recording paper P by moving the carriage 22 in the main scanning direction while the ink is discharged, but the ink jet printer may be configured as a line printer which performs printing of one pass with respect to the recording paper P by discharging the ink from lined up nozzles which are disposed in a direction substantially vertical to the transport direction of the recording paper P.

In the ink jet printer 20 of this embodiment, the ink is discharged onto the recording paper P, but other liquids excepting the ink or liquids (dispersion liquids) having particles of a functional material dispersed therein, fluids such as a gel, or the like may be discharged.

In the ink jet printer 20 of this embodiment, as the recording paper P, the lenticular lens is used, but a printing medium having other lens sheets such as a fly-eye lens in which a plurality of lens bodies are disposed in parallel may be used.

Furthermore, the invention is not limited to the embodiments described above, and it is obvious that the invention will be executed by various aspects within a technical range of the invention.

The invention is able to be used in a manufacturing industry of a printing apparatus.

What is claimed is:

1. A printing apparatus which performs printing by discharging fluid from a printing head onto a first printing medium having a lens sheet and a second printing medium different from the first printing medium, comprising:

a transport unit which transports the first printing medium and the second printing medium to a fluid discharge region in which the printing head is able to discharge the fluid;

a printing head movement unit which reciprocates the printing head in a main scanning direction;

a tray for printing in which the first printing medium is able to be set; and a control unit which controls the printing head, the transport unit, and the printing head movement unit such that a velocity of the printing head with respect to the first printing medium at the time of performing printing by discharging the fluid from the printing head onto the first printing medium is slower than a velocity of the printing head with respect to the second printing medium at the time of performing printing by discharging the fluid from the printing head onto the second printing medium, wherein at the time of performing printing by discharging the fluid from the printing head onto the first printing medium, the control unit further controls the printing head and the printing head movement unit such that the printing head discharges the fluid onto the first printing medium when the printing head is moved in a first direction away from a home position of the printing head along the main scanning direction, and controls the printing head and the printing head movement unit such that the printing head does not discharge the fluid while the printing head is moved at a velocity, which is faster than a velocity at the time of moving the printing head in the first direction, when the printing head is moved in a second direction toward the home position of the printing head, the transport unit is formed such that the tray for printing is able to be inserted from a downstream side of a sub-scanning direction, and includes a first roller which is provided on an upstream side of the sub-scanning direction from the printing head and transports the tray for printing, and a second roller which is provided on a downstream side of the sub-scanning direction from the printing head and transports the tray for printing, and the control unit controls the printing head and the printing head movement unit such that when the tray for printing having the first printing medium set therein is transported by the first roller and the second roller, printing is performed with respect to the first printing medium by discharging the fluid from the printing head while the printing head is moved at a velocity which is faster than a velocity at the time of transporting the tray for printing having the first printing medium set therein by either the first roller or the second roller.

2. The printing apparatus according to claim 1, wherein the first printing medium is formed such that a plurality of lens bodies are disposed in parallel, and the lens body disposed on one end portion has low shape accuracy compared to the other lens bodies, and the control unit controls the printing head such that a fluid discharge is performed from an end portion of the first printing medium which is opposite to the one end portion as a discharge start position when printing is performed with respect to the first printing medium.

3. The printing apparatus according to claim 2, wherein at the time of performing printing with respect to the first printing medium, the control unit controls the printing head and the printing head movement unit such that the fluid is discharged when the printing head is moved in a direction to the one end portion from the other end portion of the first printing medium, and controls the printing head and the printing head movement unit such that the printing head is moved at a velocity which is faster than a velocity at the time of moving the printing head in the direction to the one end portion from the other end portion without discharging the fluid when the printing head is moved in a direction to the other end portion from the one end portion of the first printing medium.

4. A printing method in which a transport unit is used to transport a first printing medium having a lens sheet and a second printing medium different from the first printing medium to a fluid discharge region in which a printing head is able to discharge fluid, a printing head movement unit is used to reciprocate the printing head in a main scanning direction, and a tray for printing is used to have the first printing medium set therein, the printing method comprising:

performing printing by discharging the fluid from the printing head onto the first printing medium by setting a velocity of the printing head with respect to the first printing medium at the time of performing printing by discharging the fluid from the printing head onto the first printing medium to be slower than a velocity of the printing head with respect to the second printing medium at the time of performing printing by discharging the fluid from the printing head onto the second printing medium, wherein the performing of the printing includes discharging the fluid from the printing head onto the first printing medium when the printing head is moved in a first direction away from a home position of the printing head along the main scanning direction, and not discharging the fluid from the printing head while moving the printing head at a velocity, which is faster than a velocity at the time of moving the printing head in the first direction, when the printing head is moved in a second direction toward the home position of the printing head, the printing method further comprising:

forming the transport unit such that the tray for printing is able to be inserted from a downstream side of a sub-scanning direction, wherein the transport unit includes a first roller which is provided on an upstream side of the sub-scanning direction from the printing head and transports the tray for printing, and a second roller which is provided on a downstream side of the sub-scanning direction from the printing head and transports the tray for printing; and performing printing with respect to the first printing medium, when the tray for printing having the first printing medium set therein is transported by the first roller and the second roller, by discharging the fluid from the printing head while the printing head is moved at a velocity which is faster than a velocity at the time of transporting the tray for printing having the first printing medium set therein by either the first roller or the second roller.

* * * * *